US009249772B2

(12) United States Patent
Park et al.

(10) Patent No.: US 9,249,772 B2
(45) Date of Patent: Feb. 2, 2016

(54) STARTER PINION ENGAGEMENT TESTER

(75) Inventors: Dong Ju Park, Oklahoma City, OK (US); Daniel Joseph Clark, Edmond, OK (US); David Leonel Villarreal, Edmond, OK (US); John Shingler, Edmond, OK (US)

(73) Assignee: Remy Technologies, LLC, Pendleton, IN (US)

( * ) Notice: Subject to any disclaimer, the term of this patent is extended or adjusted under 35 U.S.C. 154(b) by 269 days.

(21) Appl. No.: 13/571,941

(22) Filed: Aug. 10, 2012

(65) Prior Publication Data

US 2014/0041484 A1 Feb. 13, 2014

(51) Int. Cl.
*F02N 11/10* (2006.01)

(52) U.S. Cl.
CPC ..... *F02N 11/108* (2013.01); *Y10T 74/132* (2015.01)

(58) Field of Classification Search
CPC ..... F02N 15/06; F02N 15/02; F02N 15/067; F02N 15/065; F02N 11/087; F02N 11/00; F02N 11/04; F02N 11/006; F02N 15/00; F02N 2200/043; G01R 31/362; G01R 31/3693
USPC ..... 74/7 A, 7 B, 7 C, 7 E, 7 R; 73/114.59
See application file for complete search history.

(56) References Cited

U.S. PATENT DOCUMENTS

| | | | | |
|---|---|---|---|---|
| 3,788,151 | A * | 1/1974 | Campau | 74/7 A |
| 4,731,601 | A * | 3/1988 | Nowakowski et al. | 340/439 |
| 4,821,588 | A * | 4/1989 | Akae et al. | 74/7 A |
| 5,130,586 | A * | 7/1992 | Miyaji et al. | 310/83 |
| 5,402,758 | A * | 4/1995 | Land et al. | 123/179.3 |
| 6,445,158 | B1 | 9/2002 | Bertness et al. | |
| 7,302,870 | B2 * | 12/2007 | Vilou et al. | 74/7 C |
| 8,272,360 | B2 * | 9/2012 | Hartmann et al. | 123/179.3 |
| 8,513,825 | B2 * | 8/2013 | Suzuki | 290/38 R |
| 2004/0118194 | A1 | 6/2004 | Raichle | |
| 2007/0152702 | A1 | 7/2007 | Raichle et al. | |
| 2008/0127927 | A1 * | 6/2008 | Hirning et al. | 123/179.3 |
| 2008/0162007 | A1 * | 7/2008 | Ishii et al. | 701/54 |
| 2009/0125179 | A1 | 5/2009 | Miller et al. | |
| 2009/0267553 | A1 * | 10/2009 | Labbe et al. | 318/430 |
| 2010/0264765 | A1 * | 10/2010 | Haruno et al. | 310/71 |
| 2010/0299053 | A1 * | 11/2010 | Okumoto et al. | 701/113 |

FOREIGN PATENT DOCUMENTS

| | | |
|---|---|---|
| GB | 2102130 | 1/1983 |

* cited by examiner

*Primary Examiner* — William Kelleher
*Assistant Examiner* — Juse Agendia
(74) *Attorney, Agent, or Firm* — Faegre Baker Daniels LLP

(57) ABSTRACT

A method and apparatus for testing a starter assembly for an engine is provided. A test apparatus may include a controller operative to route power from a power supply to a tested starter assembly. The test apparatus may analyze a condition of the tested starter assembly based on monitored signals at one or more terminals of the starter assembly. A testing method may include monitoring an operating condition of the tested starter assembly during application of a variable voltage and/or current to an input of the starter assembly.

15 Claims, 10 Drawing Sheets

STARTER PINION ENGAGEMENT TESTER

FIELD OF THE DISCLOSURE

The present disclosure relates generally to the field of engine starters, and more particularly to a method and apparatus for testing an engine starter assembly.

BACKGROUND AND SUMMARY

Many vehicles with combustion engines include a starter assembly, typically including a solenoid and a motor, for cranking the vehicle's engine. Upon energizing the starter assembly, an engagement member, such as a pinion gear, coupled to the starter motor moves into engagement with the engine. An energized solenoid or field coil serves to hold the pinion gear in engagement with the engine. In some starter assemblies, the energized solenoid causes power from the vehicle battery to be routed to the starter motor to drive the starter motor. The starter motor drives the pinion gear in rotation to crank the engine.

Starter assemblies may sometimes fail intermittently for various reasons, such as improper pinion engagement, loose or shorted connections, ground connections, reversed connections, solenoid failures, motor failures, etc. For example, a faulty or weak solenoid or improper solenoid connection may result in an engagement failure of the starter assembly.

According to an illustrative embodiment of the present disclosure, a method of testing an engine starter assembly is provided. The method includes providing a starter assembly including a solenoid, a motor, an actuating device, and an engagement member coupled to the actuating device. The actuating device is configured to move the engagement member relative to the motor upon electrical power being routed to an input of the starter assembly. The method further includes positioning a blocking member proximate a shaft of the motor to block a movement of the engagement member along the shaft of the motor. The method further includes energizing the starter assembly to cause the actuating device to move the engagement member into contact with the blocking member. The method further includes analyzing at least one of a voltage level and a current level at an electrical terminal of at least one of the motor and the solenoid while the engagement member is in contact with the blocking member to determine an operating condition of the starter assembly.

According to another illustrative embodiment of the present disclosure, a method of testing an engine starter assembly is provided. The method includes providing a starter assembly including a solenoid, a motor, and an engagement member, the engagement member being configured to move along a shaft of the motor to engage an engine assembly. The method further includes applying electrical power to at least one input of the starter assembly to energize the solenoid, the starter assembly being configured to route electrical power received at the at least one input of the starter assembly to the motor. The method further includes varying a magnitude of the electrical power applied to the at least one input of the starter assembly, monitoring at least one of a voltage level and a current level of the electrical power routed to the motor of the starter assembly during the varying of the applied electrical power, and analyzing an operating condition of the starter assembly based on the monitoring.

According to yet another illustrative embodiment of the present disclosure, a testing system for an engine starter assembly is provided. The starter assembly includes a motor having an output shaft, a solenoid configured to route electrical power to the motor to drive the motor, and an engagement member configured to move along the output shaft into an engagement with an engine based on an actuation of the solenoid. The testing system includes a power supply operative to provide electrical power to the solenoid, a blocking member positioned proximate the output shaft of the motor to block a movement of the engagement member along the output shaft of the motor; and a controller operative to route electrical power from the power supply to the solenoid to actuate the solenoid to move the engagement member into contact with the blocking member. The controller is further operative to analyze the presence of an electrical connection between an input of the solenoid and an output of the solenoid while the engagement member is in contact with the blocking member.

In one example, the controller is operative to route an electrical signal from the power supply to the input of the solenoid and to monitor the output of the solenoid for the electrical signal to analyze the presence of an electrical connection between the input and the output of the solenoid while the engagement member is in contact with the blocking member. In another example, the controller routes a substantially constant voltage from the power supply to a second input of the solenoid to actuate the solenoid, and a magnitude of the substantially constant voltage is less than a magnitude of a voltage applied by a vehicle battery to the solenoid to actuate the solenoid during a non-testing operation of the solenoid. In yet another example, a magnitude of the electrical signal applied to the input of the solenoid is less than a magnitude of an electrical signal operative to rotate the motor. In still another example, the controller identifies a failed operation of the starter assembly upon a failure to detect the electrical connection between the input of the solenoid and the output of the solenoid. In another example, the output shaft of the motor includes a travel stop adapted to limit the travel of the engagement member, and the blocking member is positioned between the travel stop and the engagement member to block a full extension of the engagement member along the output shaft of the motor. In yet another example, the starter assembly includes a lever assembly coupled to the engagement member and to a plunger of the solenoid, and the actuation of the solenoid causes movement of the plunger and the lever assembly to cause the engagement member to move into contact with the blocking member. In still another example, the solenoid includes a contact plate coupled to the plunger and configured to provide an electrical connection between the input and output of the solenoid during an actuation of the solenoid. In another example, the controller includes a control unit, a computer, and a computer interface providing communication between the control unit and the computer, the control unit controls the delivery of electrical power from the power supply to the solenoid, and the computer analyzes the presence of an electrical connection between the input of the solenoid and the output of the solenoid while the engagement member is in contact with the blocking member.

According to still another illustrative embodiment of the present disclosure, a testing system for an engine starter assembly is provided. The starter assembly includes a solenoid and a motor. The solenoid has at least one input and an output. The testing system includes at least one power supply operative to provide electrical power to the solenoid and a controller operably coupled to the at least one power supply and to the starter assembly. The controller is operative to apply a voltage from the at least one power supply to the at least one input of the solenoid to actuate the solenoid. The solenoid when actuated is configured to route the applied voltage to the output of the solenoid. The controller is further operative to vary the voltage applied to the at least one input of the solenoid, to monitor the output of the solenoid during the varying of the applied voltage, and to analyze an operating condition of the starter assembly based on the monitored output of the solenoid.

In one example, the controller varies the applied voltage by decreasing the applied voltage at a substantially steady rate over a predetermined period. In another example, the controller is further operative to calculate a voltage difference between the applied voltage and a voltage monitored at the output of the solenoid, compare the calculated voltage difference to a difference threshold, and identify a voltage level of the applied voltage upon the calculated voltage difference exceeding the difference threshold. In yet another example, the controller is further operative to compare the identified voltage level of the applied voltage to a threshold voltage level and to determine that the operating condition of the starter assembly is a faulted condition upon the identified voltage level of the applied voltage exceeding the threshold voltage level. In still another example, the controller applies the voltage from the at least one power supply to a first input of the solenoid to actuate the solenoid and to a second input of the solenoid, and the solenoid is configured to route the applied voltage from the second input of the solenoid to the output of the solenoid upon being actuated by the applied voltage at the first input of the solenoid. In another example, prior to applying the voltage to the first and second inputs of the solenoid, the controller is further operative to apply an electrical signal to one of the second input and the output of the solenoid while power to the first input is substantially removed and to monitor the other of the second input and the output of the solenoid to detect at least one of a solenoid leakage current and a reverse installation of the solenoid. In yet another example, the controller includes a control unit, a computer, and a computer interface providing communication between the control unit and the computer, the control unit controls the delivery of electrical power from the power supply to the solenoid, and the computer analyzes an operating condition of the starter assembly based on the monitored output of the solenoid.

BRIEF DESCRIPTION OF THE DRAWINGS

The detailed description of the drawings particularly refers to the accompanying figures in which.

DETAILED DESCRIPTION OF THE DRAWINGS

Figure 1:
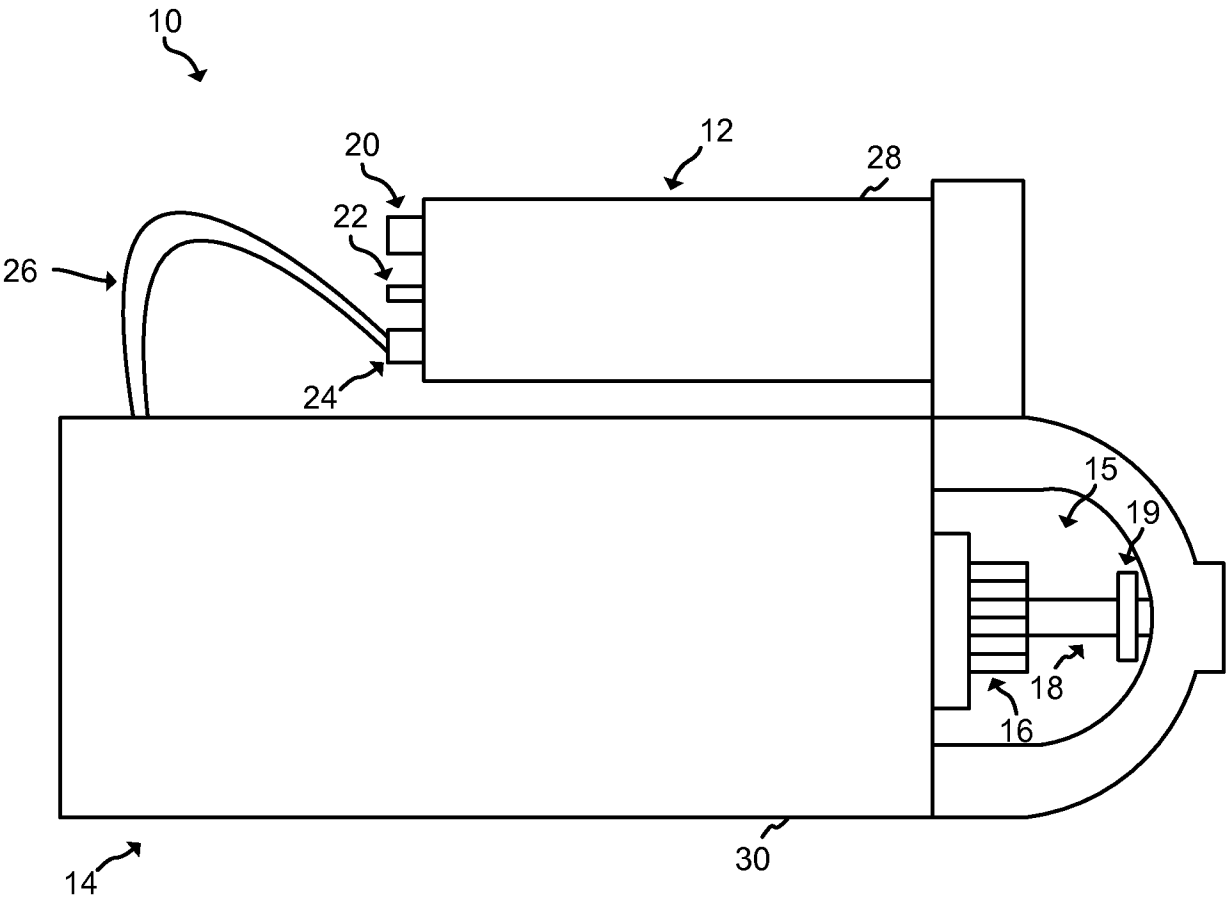
FIG. 1 illustrates an exemplary starter assembly according to one embodiment including a solenoid and a starter motor.

For the purposes of promoting an understanding of the principles of the present disclosure, reference will now be made to the embodiments illustrated in the drawings, which are described herein. The embodiments disclosed herein are not intended to be exhaustive or to limit the invention to the precise form disclosed. Rather, the embodiments are chosen and described so that others skilled in the art may utilize their teachings. Therefore, no limitation of the scope of the claimed invention is thereby intended. The present invention includes any alterations and further modifications of the illustrated devices and described methods and further applications of the principles of the invention which would normally occur to one skilled in the art to which the invention relates.

Referring to FIG. 1, an exemplary starter assembly 10 is illustrated according to one embodiment that is operative to start or crank an engine of a vehicle. Starter assembly 10 includes an electromagnetic device, illustratively a solenoid 12, coupled to a starter motor or power pack 14. Solenoid 12 includes a pair of input terminals, illustratively a battery terminal 20 and a solenoid terminal 22, and an output terminal, illustratively motor terminal 24, that provide electrical connections to other components of a vehicle electrical system. In the illustrated embodiment, battery terminal 20 serves as a power input to starter motor 14 through solenoid 12 and connects to a positive terminal of a power source (e.g., battery, etc.). Solenoid terminal 22 serves as a power input to solenoid 12 and connects to a power source (e.g., battery, etc.) for energizing solenoid 12. Motor terminal 24 serves as a power output and connects to motor 14 to route power received from battery terminal 20 to motor 14 via cable 26. Solenoid 12 serves as a relay or switch by routing power received at battery terminal 20 to motor 14 upon activation of solenoid 12 via solenoid terminal 22, as described herein. In one embodiment, starter motor 14 is a direct current (DC) motor 14 including an armature, field coil, and brushes, although other suitable motor types may be used. A drive mechanism 15 coupled to the output of motor 14 includes a shaft 18 and an engagement member 16, illustratively a pinion gear 16. Pinion gear 16 is configured to move along shaft 18 and to engage a gear or flywheel of an engine (see, for example, flywheel 84 of FIG. 2) to drive the engine. A travel stop 19 is provided on shaft 18 to provide a hard stop to limit the travel of pinion 16. Drive mechanism 15 further includes a lever assembly 58 coupled to pinion 16 and to solenoid 12, as described herein with respect to FIG. 2. Respective housings 28, 30 of solenoid 12 and motor 14 are illustratively rigidly coupled to each other, although other suitable configurations may be provided. Solenoid 12 is illustratively external to the motor housing 30. Alternatively, solenoid 12 is internal to motor housing 30, such as with starter assembly 162 illustrated in FIG. 6 and described herein.

Figure 2:
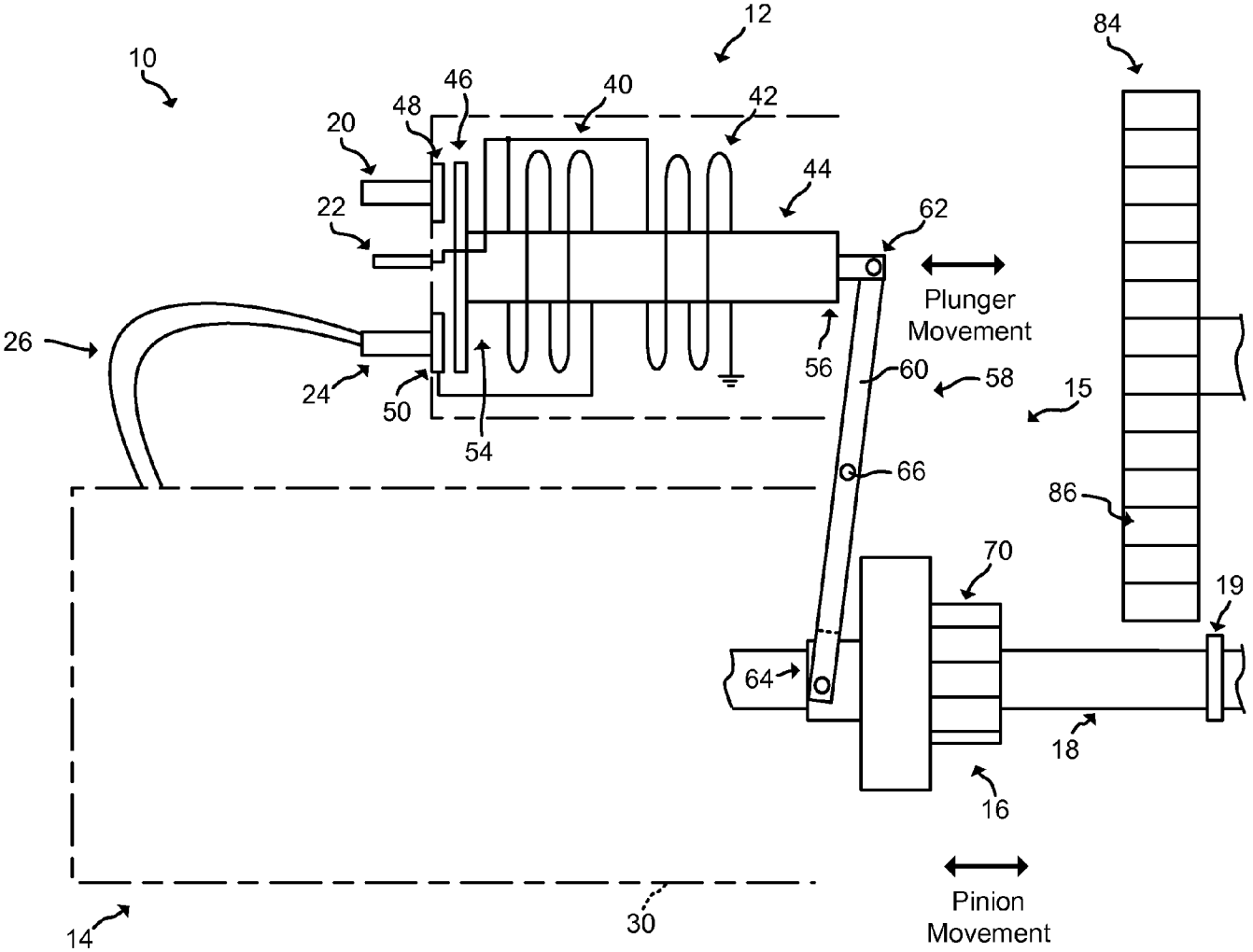
FIG. 2 illustrates the starter assembly of FIG. 1, illustrating details of a drive mechanism, including a pinion gear and a lever assembly, coupled to a plunger of the solenoid.

Referring to FIG. 2, exemplary starter assembly 10 of FIG. 1 is illustrated in detail according to one embodiment. Solenoid 12 includes a pair of electromagnetic windings or coils, illustratively a pull-in coil 40 and a hold-in coil 42, and a moveable plunger 44 positioned in an interior region of coils 40, 42. Hold-in coil 42 is coupled to ground, and pull-in coil is routed to motor terminal 24. A contact plate or disk 46 is coupled at one end 54 of plunger 44, and lever assembly 58 is coupled at an opposite end 56 of plunger 44. Lever assembly 58 and plunger 44 cooperate to serve as an actuating device for moving pinion 16 along shaft 18 relative to motor 14. Battery terminal 20 includes a battery terminal contact 48 extending into the interior of solenoid 12, and motor terminal 24 includes a motor terminal contact 50 extending into the interior of solenoid 12. Contact plate 46 of plunger 44 is configured to engage battery terminal contact 48 and motor terminal contact 50 upon movement of plunger 44 towards contacts 48, 50 to provide an electrical path therebetween. Lever assembly 58 is operative to cause movement of pinion gear 16 axially along shaft 18 in response to corresponding movement of plunger 44. Lever assembly 58 includes a shift-lever 60 coupled to plunger 44 at a pivot connection 62 and engaged with pinion 16 at engagement end 64. In one embodiment, shift-lever 60 has a wishbone- or Y-shape with end 64 straddling pinion 16. Shift-lever 60 is configured to pivot about a fixed pivot 66, such as a rod, screw, hinge, or other suitable pivoting mechanism coupled to a structure of starter assembly 10. Other suitable linkages may be coupled to plunger 44 to move pinion gear 16 along shaft 18 of starter motor 14 based on movement of plunger 44.

In operation, battery terminal 20 is connected to a power source, such as the positive terminal of a vehicle battery, for example. With no power routed to solenoid terminal 22, solenoid 12 is de-energized and battery terminal 20 is isolated from motor terminal 24. Upon applying voltage from a power source (e.g., 12 VDC from the vehicle battery) to solenoid terminal 22 (i.e., upon an operator turning the ignition switch to "start"), electrical current is routed from the power source through pull-in coil 40 and hold-in coil 42 to create a magnetic field that pulls plunger 44 towards contacts 48, 50. In the illustrated embodiment, pull-in coil 40 is grounded via the connection to motor terminal 24 and motor 14.

As plunger 44 is pulled towards contacts 48, 50, shift-lever 60 pivots about pivot 66 to push pinion gear 16 along shaft 18 towards the engine flywheel 84. In one embodiment, shaft 18 includes splines that engage pinion 16. Teeth 70 of pinion gear 16 are configured to matingly engage or mesh with teeth 86 of flywheel 84, as illustrated with engagement 88 of FIG. 3. Once engaged, a rotation of shaft 18 and pinion gear 16 by motor 14 is operative to cause corresponding rotation of flywheel 84 to turn engine 80.

Figure 3:
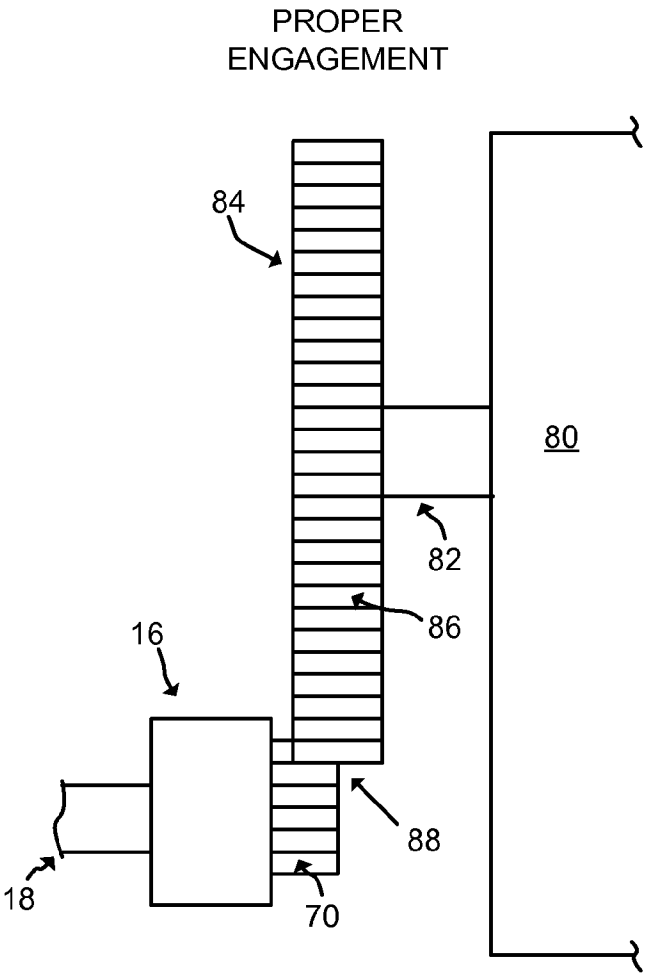
FIG. 3 illustrates an engagement of the pinion gear of FIG. 2 to a flywheel of an engine.

With pinion gear 16 engaging flywheel 84, plunger 44 is engaged with contacts 48, 50 of respective terminals 20, 24. In other words, when teeth 70 of pinion gear 16 are in full or substantially full mating engagement with teeth 86 of flywheel 84, plunger 44 is at the end of its travel and abuts contacts 48, 50. Upon contact plate 46 of plunger 44 being pulled into engagement with contacts 48, 50, referred to herein as contact plate 46 of solenoid 12 being "closed," electrical power from battery terminal 20 is routed through contact plate 46 to motor terminal 24 and motor 14 to cause rotation of motor 14. The rotation of motor 14 causes corresponding rotation of shaft 18 and pinion 16 to turn flywheel 84 and to crank engine 80 (FIG. 3).

In the illustrated embodiment, after power to solenoid terminal 22 is removed, coils 40 and 42 are de-energized, and plunger 44 is pulled away from contacts 48, 50 via one or more biasing members (e.g., springs) (not shown). With contact 46 open, motor 14 stops and plunger 44 retracts drive mechanism 15 to disengage pinion 16 from flywheel 84.

Figure 4:
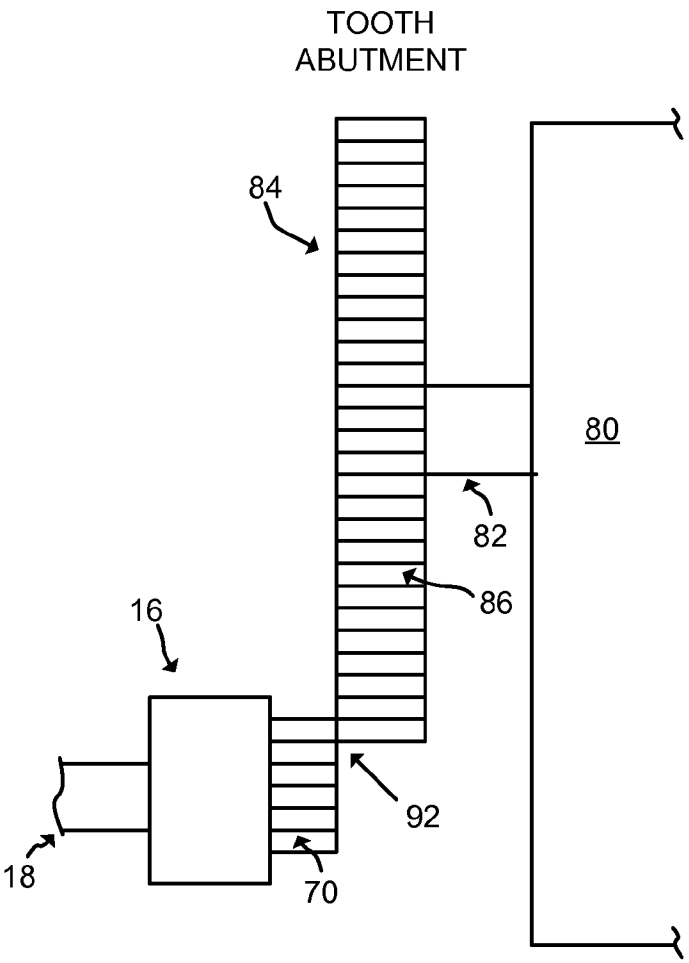
FIG. 4 illustrates an abutment of the pinion gear of FIG. 2 against a flywheel of an engine.

In some starter assemblies, pinion gear 16 may fail to properly engage flywheel 84 during the starting sequence of engine 80 due to, for example, misalignment of pinion teeth 70 and flywheel teeth 86. Other exemplary causes of an improper pinion engagement include a failure or fault with the solenoid 12, the motor 14, the connections between solenoid 12 and motor 14, or the drive mechanism 15. Referring to FIG. 4, an exemplary failed engagement shows the teeth 70 of pinion gear 16 abutting the teeth 86 of flywheel 84 rather than meshing with teeth 86. Pinion gear 16 is extended towards flywheel 84 based on movement of plunger 44 and shift-lever 60 (FIG. 2), but teeth 70 are not properly aligned with teeth 86 to mesh with teeth 86. As such, the pinion abutment 92 illustrated in FIG. 4 prevents actuation of flywheel 84 and therefore prevents the cranking of engine 80. Such a failed pinion engagement may be referred to as a "click-no-crank" condition, as the pinion 16 is moved by solenoid 12 against flywheel 84 but fails to engage flywheel 84 to crank the engine 80.

In some embodiments, solenoid 12, drive mechanism 15, and pinion gear 16 are configured such that, even in an abutment condition with pinion 16 abutting flywheel 84 rather than mating with flywheel 84, plunger 44 engages contacts 48, 50 to allow battery power to be routed to motor 14 to turn motor 14. In particular, starter assembly 10 may be designed such that plunger 44 engages contacts 48, 50 at substantially the same time that pinion 16 abuts flywheel 84 or that pinion 16 moves substantially close to flywheel 84. As such, in these embodiments, power is routed to motor 14 from battery terminal 20 even in an abutment condition such that the actuation of motor 14 may cause pinion 16 and flywheel 84 to move into alignment to facilitate the meshing of the respective teeth 70, 86.

Figure 5:
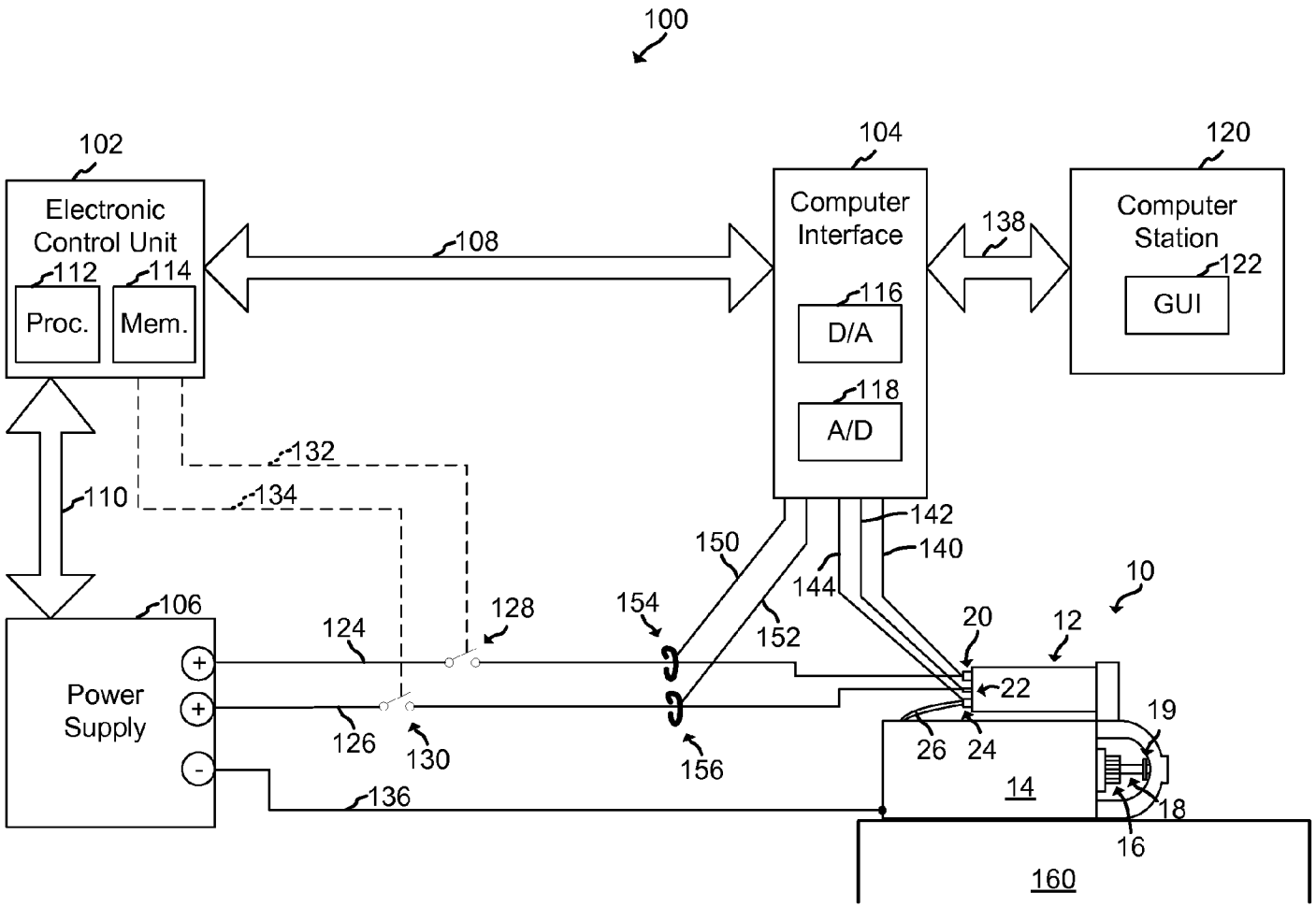
FIG. 5 illustrates an exemplary test apparatus according to an embodiment including a controller and a power supply operatively coupled to the starter assembly of FIGS. 1 and 2.

Referring to FIG. 5, an exemplary test apparatus 100 is illustrated including an electronic control unit 102, a computer interface 104, a computer station 120, and a power supply 106. Test apparatus 100 is operative to test for proper engagement of pinion 16 (FIG. 2) of the starter assembly to the flywheel of an engine. In particular, test apparatus 100 is operative to simulate a tooth abutment condition (FIG. 4) to verify proper solenoid function, as described herein with respect to the blocked pinion test of FIGS. 7 and 8. Test apparatus 100 is further operative to test other operations and functionalities of starter assembly 10, such as described herein with respect to the chatter voltage and solenoid leakage tests of FIGS. 9-11. While test apparatus 100 is described herein with respect to testing starter assembly 10 of FIG. 2, test apparatus 100 may be used to test other starter assemblies, such as starter assembly 162 of FIG. 6, for example.

Control unit 102 of test apparatus 100 includes a processor 112 and a memory 114 accessible by processor 112. Memory 114 includes software containing instructions that when executed by processor 112 cause control unit 102 to perform the functions and operations described herein. An exemplary control unit 102 includes a programmable logic controller (PLC) or other suitable control device. As described herein, control unit 102 is operative to control the delivery of electrical power from power supply 106 to starter assembly 10. As such, power supply 106 simulates a vehicle battery during the testing operations. In the illustrated embodiment, control unit 102 is operative to provide variable voltage from power supply 106 to solenoid 12. Control unit 102 is connected to power supply 106 via communication link 110 and to computer interface 104 via communication link 108. Communication links 108, 110 may be any suitable communication bus or lines, such as one or more electrical conductors. In an exemplary embodiment, power supply 106 provides 12 VDC at 300 amps (A), although other suitable power supplies 106 may be provided. Computer station 120, which includes a graphical user interface (GUI) 122, is operative to collect and analyze data detected with control unit 102. For example, computer 120 collects voltage and current readings detected with control unit 102 via computer interface 104 and analyzes the readings to make determinations regarding the condition of starter assembly 10, as described herein. Computer interface 104 is coupled to computer 120 via communication bus or link 138. Computer interface 104, illustratively controlled by control unit 102, includes one or more digital-to-analog converters 116 and one or more analog-to-digital converters 118 for communicating control and feedback signals between control unit 102, starter assembly 10, and computer 120.

A positive terminal of power source 106 is coupled to battery terminal 20 of solenoid 12 via power line 124. Another positive terminal of power source 106 is coupled to solenoid terminal 22 of solenoid 12 via power line 126. In another embodiment, two power supplies 106 are provided with a first power supply coupled to battery terminal 20 and a second power supply coupled to solenoid terminal 22. Starter assembly 10 is further coupled to the negative or ground terminal of power source 106 via line 136. In one embodiment, lines 124, 126, 136 include electrical cables or wires. Lines 124, 126 are coupled to respective switches 128, 130 that are controlled by control unit 102 via respective communication lines 132, 134, e.g., electrical wires. Exemplary switches 128, 130 include dry switches (e.g., electromagnetic switches). Control unit 102 provides control signals to selectively close switches 128, 130 to route power from power source 106 to terminals 20, 22 of starter assembly 10 during the diagnostic testing of starter assembly 10, as described herein.

A plurality of electrical leads 140, 142, 144 are routed from input/output (I/O) ports of computer interface 104 to terminals 20, 22, 24 of starter assembly 10 to allow control unit 102 to monitor voltage and/or current values at terminals 20, 22, 24. In particular, lead 140 is coupled to battery terminal 20 of solenoid 12, lead 142 is coupled to solenoid terminal 22 of solenoid 12, and lead 144 is coupled to motor terminal 24 of solenoid 12. Leads 140, 142, 144 may include any suitable electrical conductor, e.g., electrical cable or wire. The ends of leads 140, 142, 144 include clamps or other connectors (not shown) for coupling to the terminals of solenoid 12. Additionally, electrical leads or cables 150, 152 include current sensors 154, 156 operative to detect the electrical current through power lines 124, 126, respectively. Current sensors 154, 156 are illustratively Hall effect sensors 154, 156 with current sensing loops that are operative to detect electrical currents in power lines 124, 126 and to provide a signal proportional to the detected electrical currents to control unit 102. Other suitable current sensors 154, 156 may be provided.

Control unit 102, computer 120, and computer interface 104 collectively function as the controller of test apparatus 100. Control unit 102 and computer 120 are not required to be separate devices. For example, control unit 102 and computer 120 may be provided as a single processing device that controls power supply 106 and the test apparatus 100 and also collects and analyzes data to diagnose the tested starter assembly 10. In another embodiment, electronic control unit 102, computer interface 104, and power supply 106 are integrated into a single apparatus or device 100 that is configured to couple to computer 120 via link 138 and to starter assembly 10 via leads 140, 142, 144 and lines 124, 126, 136. Other suitable configurations of test apparatus 100 may be provided. For example, electronic control unit 102 and computer interface 104 may be integrated into a device with one or more power supplies 106 coupled externally to the device.

In the illustrated embodiment, a test bench 160 or other suitable testing station or mounting assembly is provided for holding the starter assembly 10 during a test. The starter assembly 10 to be tested is positioned and secured to the test bench 160 prior to performing a test with test apparatus 100.

In one embodiment, memory 114 of control unit 102 stores one or more lookup tables that provide a list of different types, models, and/or part numbers of starter assemblies 10 and the corresponding test data (e.g., comparison values for monitored current/voltages) to be used for various tested starter assemblies 10. For example, different starter assemblies 10 may have different expected voltage and/or current values at terminals 20, 22, 24 or different response times depending on the configuration and design of the starter assemblies 10. In one embodiment, a user selects the appropriate type, model, and/or part number of the starter assembly 10 to be tested via the GUI 122 of computer 120. Alternatively, a memory of computer station 120 may store the lookup tables.

Figure 6:
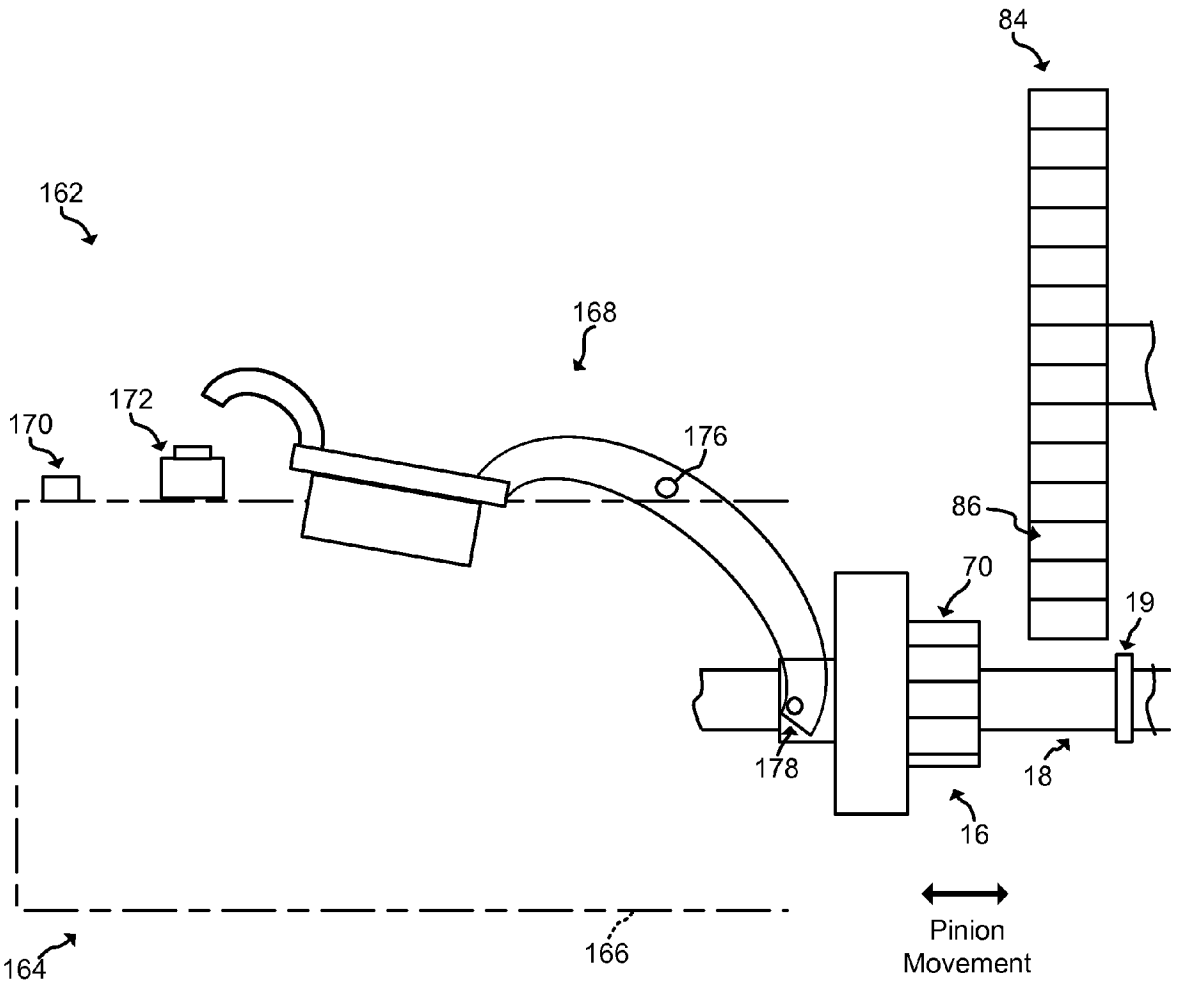
FIG. 6 illustrates another exemplary starter assembly according to one embodiment configured to be tested with the test apparatus of FIG. 5.

Referring to FIG. 6, another exemplary starter assembly 162 is illustrated that is configured to be tested with test apparatus 100 of FIG. 5. Starter assembly 162 includes a motor 164 and an internal solenoid (e.g., one or more field coils) in a housing 166. When the internal solenoid is energized, the resulting electromagnetic field is operative to pull an actuating device 168, illustratively a moveable pole shoe 168, into engagement with a bypass switch 172. In one embodiment, bypass switch 172 includes normally closed contacts that grounds power from an electrical terminal 170. Pole shoe 168 is pivotally coupled to pinion 16 at end 178 and is configured to pivot about a fixed pivot connection 176. Upon being pulled towards bypass switch 172 with the energized internal solenoid, pole shoe 168 serves as a lever assembly by pivoting about pivot connection 176 and pushing pinion 16 into engagement with flywheel 84 of the engine.

In operation, input terminal 170 of starter assembly 162 is connected to a power source, such as the positive terminal of a vehicle battery, for example. With no power routed to terminal 170 of starter assembly 162 (e.g., operator key switch is not engaged), motor 164 and the internal solenoid are de-energized, pole shoe 168 is biased away from bypass switch 172 (such as with a spring or other biasing member), and pinion 16 is retracted from flywheel 86. Upon applying voltage from a power source (e.g., 12 VDC vehicle battery) to terminal 170, current flows from terminal 170 to the field coil of motor 164 and motor 164 begins to rotate. In addition, current from terminal 170 flows to the one or more internal field coils, thereby pulling pole shoe 168 into engagement with bypass switch 172 and pushing pinion 16 into engagement with flywheel 84. Upon pole shoe 168 engaging bypass switch 172, the normally closed contacts of bypass switch 172 open. As such, power from terminal 170 is no longer grounded, and full power from terminal 170 is routed to motor 164 and distributed among the internal field coils to drive motor 164, thereby driving pinion 16 and flywheel 84 to start the engine. When power is removed from terminal 170 (e.g., operator turns a key switch to off), battery current is removed from starter assembly 162, and pole shoe 168 is biased away from bypass switch 172 causing the motor to stop and the pinion to retract from flywheel 84.

One of power lines 124, 126 of the test apparatus 100 (FIG. 5) is routed to terminal 170 to power starter assembly 162. In one embodiment, only one of electrical leads 140, 142, 144 is required for monitoring the electrical power routed to terminal 170 of starter assembly 162, although other configurations may be provided. For example, lead 144 may be coupled to terminal 170 during testing to monitor the voltage and/or current levels at the input of starter assembly 162. Similarly, a current sensor 154, 156 may be used to monitor the current routed to terminal 170.

In another embodiment, the starter assembly 10, 162 may be configured such that an acceleration of the motor shaft 18 causes the pinion 16 to move into engagement with the engine flywheel 84. As such, the motor shaft 18 serves as an actuating device to move the pinion 16 along the shaft 18. In this configuration, an internal (or external) solenoid includes a hold-in coil that, when energized, holds the pinion 16 in engagement with the flywheel 84. Other suitable starter assemblies may be provided and tested with test apparatus 100.

Figure 7:
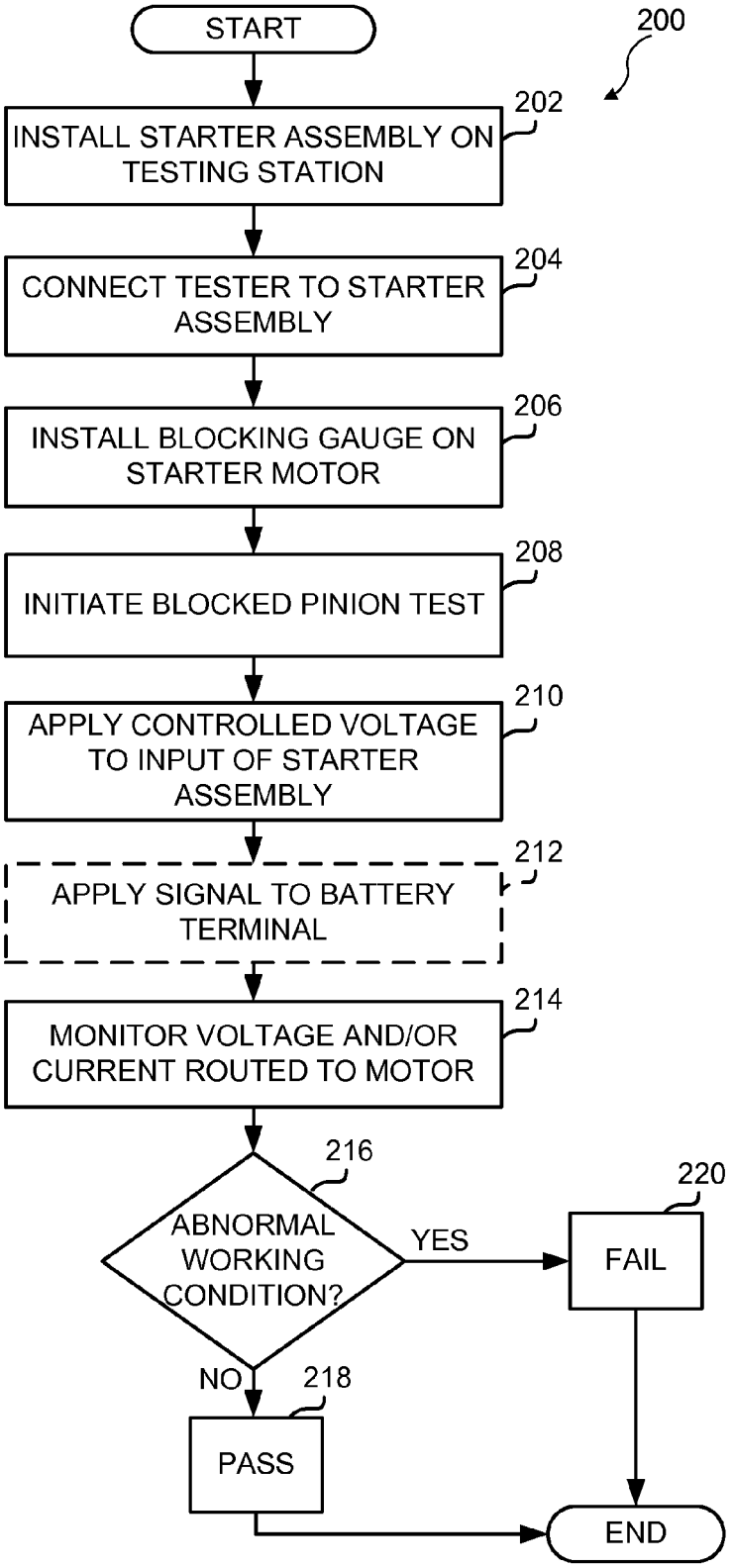
FIG. 7 illustrates an exemplary method of a blocked pinion test of the starter assembly of FIGS. 1 and 2 and of the starter assembly of FIG. 6 according to one embodiment.

Referring to FIG. 7, an exemplary method 200 of operation of test apparatus 100 of FIG. 5 is illustrated for performing a blocked pinion test of starter assembly 10 of FIG. 2. Reference is made to FIGS. 2 and 5 throughout the description of the method of FIG. 7. The method of FIG. 7 is illustratively performed with starter assembly 10 disconnected from the vehicle and connected to test bench 160 of FIG. 5, although alternative testing setups may be provided. Although the method of FIG. 7 is described with reference to the starter assembly 10 of FIG. 2, the method of FIG. 7 is also used to test the starter assembly 162 of FIG. 6 or other suitable starter assemblies, as described herein.

Figure 8B:
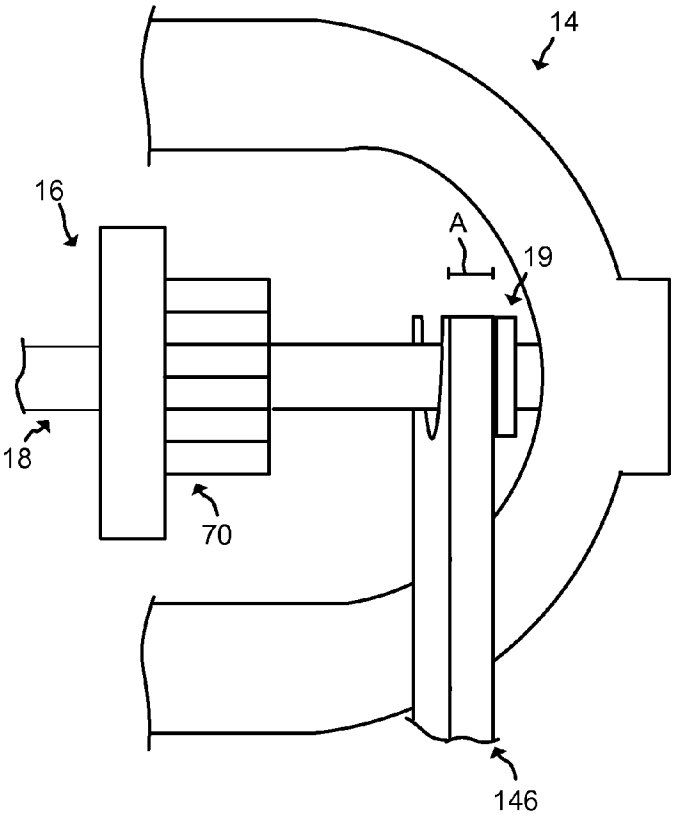
FIG. 8B illustrates the exemplary blocking member of FIG. 8A positioned between a pinion gear and a travel stop in the blocked pinion test of FIG. 7.
Figure 8A:
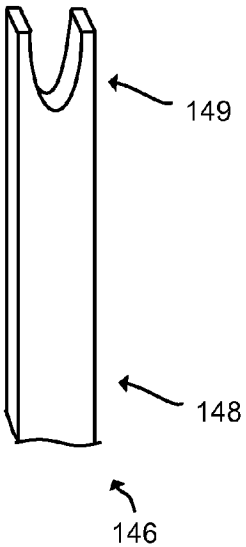
FIG. 8A illustrates an exemplary blocking member for use in the blocked pinion test of FIG. 7.

At block 202, an operator installs the starter assembly 10 to be tested on the testing station 160. In one embodiment, starter assembly 10 is secured to testing station 160 with clamps or other fasteners. At block 204, an operator connects test apparatus 100 to starter assembly 10. In particular, power lines or cables 124, 126 are coupled to respective terminals 20, 22, and ground line or cable 136 is coupled to the casing of motor 14. In addition, sensing leads or wires 140, 142, 144 are coupled to respective terminals 20, 22, 24 of solenoid 12. At block 206, a blocking gauge or other suitable blocking member is inserted adjacent or proximate shaft 18 in the travel path of pinion 16. See, for example, an exemplary blocking gauge 146 illustrated in FIGS. 8A and 8B. Blocking gauge 146 is illustratively positioned between travel stop 19 and motor 14 to block a full movement of pinion 16 towards travel stop 19. Blocking gauge 146 includes a first end 148 and a second, U-shaped end 149 that receives the shaft 18 of starter motor 14 near travel stop 19, as illustrated in FIG. 8B. First end 148 may include a handle for holding the gauge 146 in place during the test. Alternatively, blocking gauge 146 is coupled to testing station 160 (FIG. 5) and is adapted to automatically (or manually) move into engagement with shaft 18 of the tested starter assembly 10 prior to the test. Blocking gauge 146 is configured to simulate an abutment condition of the pinion 16 against a vehicle flywheel (described herein). In other words, when plunger 44 (FIG. 2) extends pinion 16, pinion 16 abuts blocking gauge 146 without being fully extended, as illustrated in FIG. 8B.

In the illustrated embodiment, gauge 146 is sufficiently sized such that, with a properly functioning starter assembly 10, the abutment of pinion 16 against gauge 146 still allows plunger 44 to engage contacts 48, 50 to allow battery power to be routed to motor 14, as described herein. The size of gauge 146 is selected based on the design specifications of the model and type of solenoid 12 and motor 14 being tested. For example, the thickness A of blocking gauge 146 differs depending on the starter assembly 10 being tested and the engine flywheel position relative to the pinion 16. As such, the blocking gauge 146 may be selected from multiple blocking gauges. An exemplary thickness of blocking gauge 146 is 9 millimeters (mm), 11 mm, or other suitable thicknesses. In one embodiment, the appropriately sized blocking gauge 146 configured for use with a specific starter assembly 10 is provided in lookup table stored in control unit 102 and accessible by a user via GUI 122. An exemplary material of blocking gauge 146 is steel.

At block 208, an operator initiates the blocked pinion test, i.e., via one or more user inputs of the test apparatus 100. For example, an operator selects a starter part number or model via computer 120 to initiate the test. In one embodiment, multiple inputs are required by an operator to start the test, such as to facilitate safe operation of the apparatus 100, for example. Upon an operator starting the test, test apparatus 100 energizes starter assembly 10 at block 210 by applying a controlled voltage to an input terminal of starter assembly 10. In particular, a controlled voltage is applied to solenoid terminal 22 of solenoid 12 at block 210 in accordance with test specifications (e.g., based on test data stored in memory 114, as described herein) to actuate the solenoid 12. In the illustrated embodiment, the controlled voltage is a substantially constant voltage configured to pull plunger 44 into contact with terminal contacts 48, 50 and to move pinion 16 into contact with blocking gauge 146 (FIG. 2). In the illustrated embodiment, the magnitude or voltage level of the controlled voltage applied at block 210 is less than the full rated voltage level of solenoid 12, i.e., the full vehicle battery voltage (e.g., 12 VDC) applied to solenoid 12 to actuate solenoid 12 during normal (non-testing) operation of the solenoid 12 in a vehicle. For example, in one embodiment, about 7 VDC is applied to solenoid terminal 22 from power supply 106 during the test to actuate solenoid 12 despite solenoid 12 being configured to receive about 12 VDC from a vehicle battery during normal non-testing operation. Other suitable voltages may be applied that are operative to pull plunger 44 against contacts 48, 50 based on the configuration of the tested solenoid 12. Such a reduced applied voltage during the test simulates the reduced voltage that would be applied to solenoid terminal 22 during non-ideal operating conditions of starter assembly 10, such as due to aged or rusted solenoid power/ground cables, poor connections, cold or hot temperatures, etc. When testing the starter assembly 162 of FIG. 6, the controlled voltage is applied to input terminal 170 at block 210 to pull pole shoe 168 into contact with bypass switch 172 and to cause pole shoe 168 to move pinion 16 into contact with blocking gauge 146.

To provide the controlled voltage, control unit 102 sends a control signal to switch 130 via line 134 to close switch 130. Control unit 102 then instructs power supply 106, i.e., via a reference control signal, to route the substantially constant voltage to solenoid terminal 22 (or terminal 170 of FIG. 6). Power supply 106 then outputs and controls the magnitude of the requested constant voltage to solenoid terminal 22. Optionally, if the applied voltage at block 210 is too weak to pull in plunger 44 (or pole shoe 168 of FIG. 6) such that the pinion 16 engages the blocking gauge 146, control unit 102 may instruct power supply 106 to increase the applied voltage by a nominal amount until the pinion 16 is moved into engagement with blocking gauge 146.

At block 212, test apparatus 100 applies an electrical signal to battery terminal 20 of solenoid 12. In one embodiment, block 212 is only performed when testing starter assembly 10 of FIG. 2 or other starter assemblies having a battery terminal 20 separate from a solenoid terminal 22. For example, the starter assembly 162 of FIG. 6 illustratively does not include an additional terminal configured to receive the electrical signal applied at block 212. At block 212, control unit 102 sends a control signal to switch 128 via line 132 to close switch 128. Control unit 102 then instructs power supply 106 to apply a signal voltage to battery terminal 20 via line 124. In the illustrated embodiment, the signal voltage applied to battery terminal 20 is a low current, high impedance signal such that application of the signal to motor 14 (via closed contact plate 46 and motor terminal 24) does not cause rotation of motor 14. Due to the high impedance of the signal, the starter motor 14 does not rotate.

At block 214, with pinion 16 abutting the blocking gauge 146, control unit 102 monitors the voltage and/or current routed to motor 14 (or motor 164). Based on the monitored voltage/current, computer 120 determines at block 216 whether the starter assembly 10 (or 162) has an abnormal working condition. In particular, when testing starter assembly 10 of FIG. 2, control unit 102 monitors at block 214 the output of solenoid 12, i.e., motor terminal 24, to detect the signal from battery terminal 20 applied at block 212. Control unit 102 monitors the applied signal at terminal 20 via lead 140 and the output signal at terminal 24 via lead 144. Based on a comparison of the voltage (or current) values at terminals 20, 24, computer 120 at block 216 determines whether contact disk 46 of plunger 44 (FIG. 2) is closed to form an electrical connection between the terminals 20, 24, i.e., whether contact disk 46 is abutting contacts 48, 50 of FIG. 2.

In the illustrated embodiment, if the detected voltage at terminal 24 is equal or substantially equal to the detected voltage at terminal 20, contact plate 46 is determined to be closed. As such, the tested starter assembly 10 is determined to be operating properly according to the blocked pinion test, and the test results in a PASS condition at block 218. If the detected voltage at terminal 24 is not substantially equal to the detected voltage at terminal 20 or is varying inconsistent with the voltage at terminal 20, contact plate 46 is determined to be open despite the application of voltage at the solenoid terminal 22. As such, the tested starter assembly 10 is determined to be operating improperly according to the blocked pinion test, and the test results in a FAIL or a fault condition at block 220.

When testing starter assembly 162 of FIG. 6, control unit 102 monitors at block 214 the current level (or voltage level) at input terminal 170 during application of the controlled voltage at block 210. Computer 120 determines at block 216 whether pole shoe 168 is engaged with bypass switch 172 based on the monitored current level. In particular, if a variation in the current level (or voltage level) is detected that exceeds a threshold variation, the computer 120 determines at block 216 that pole shoe 168 is moved away from switch 172. As such, the tested starter assembly 162 is determined to be operating improperly, and the test results in a FAIL or fault condition at block 220. If the current level does not vary beyond the threshold variation, the test results in a PASS condition at block 218. The threshold variation may be set and stored at computer 120 based on the known configuration of starter assembly 162.

In one embodiment, computer 120 outputs the results of the blocked pinion test as well as the detected values (e.g., terminal voltages and currents) for display on GUI 122. In one embodiment, computer 120 further provides a printout of the test results and monitored values.

An exemplary failed condition or operation of starter assembly 10 detectable with method 200 includes an improper or lack of connection of shift lever 60 to plunger 44 and pinion 16 (FIG. 2), an improper configuration of drive mechanism 15, or improper dimensions or tolerances of drive mechanism 15. For example, as described herein, contact plate 46 (FIG. 2) will not close if the combination of drive mechanism 15 and pinion 16 fails to move plunger 44 into contact with contacts 48, 50 (FIG. 2) when pinion 16 abuts blocking gauge 146. With the abutment of pinion 16 and blocking gauge 146 being observable by the test operator, solenoid 12 is known to have actuated plunger 44 to move the pinion 16. As such, the open (or insufficiently closed) contact plate 46 may be determined to be a result of an improper configuration (e.g., poor dimensional combination, etc.) of plunger 44, drive mechanism 15, and pinion 16, for example. Similarly, a failed condition or operation of starter assembly 162 of FIG. 6 includes improper dimensions, tolerances, or configuration of pole shoe 168, bypass switch 172, and/or pinion 16. Method 200 also is used to detect pinion 16 being stuck or encountering resistance as it travels along the splines of motor shaft 18.

Figure 9:
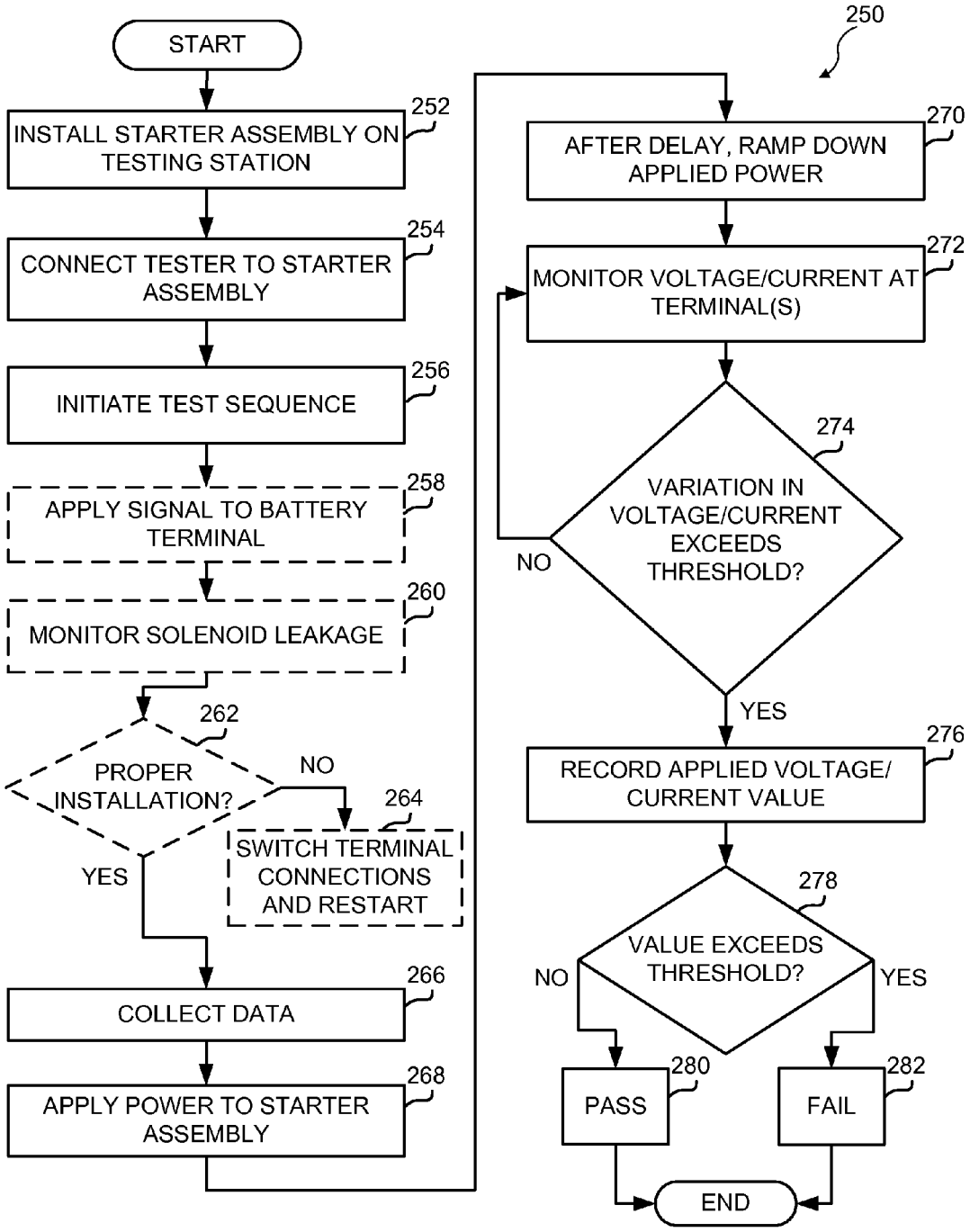
FIG. 9 illustrates an exemplary method of a chatter voltage and solenoid leakage test of the starter assembly of FIGS. 1 and 2 and of the starter assembly of FIG. 6 according to one embodiment.

Referring to FIG. 9, another exemplary method 250 of operation of test apparatus 100 of FIG. 5 is illustrated for testing the functionality and condition of starter assembly 10, 162. The method of FIG. 9 is illustratively performed with the starter assembly 10, 162 disconnected from the vehicle and connected to testing station 160 of FIG. 5 as described herein, although alternative testing setups may be provided. The method of FIG. 9 provides an exemplary chatter voltage test as well as an exemplary solenoid leakage test, and the solenoid leakage test is operative to detect a reversed installation of solenoid 12, as described herein. Reference is made to FIGS. 2 and 5 throughout the description of the method of FIG. 9. Although the method of FIG. 9 is described with reference to the starter assembly 10 of FIG. 2, the method of FIG. 9 is also used to test the starter assembly 162 of FIG. 6 or other suitable starter assemblies, as described herein.

At block 252, an operator installs the starter assembly 10 on the testing station 160. At block 204, an operator connects test apparatus 100 to starter assembly 10. In particular, power lines or cables 124, 126 are coupled to respective terminals 20, 22, and ground line or cable 136 is coupled to motor 14. In addition, sensing leads or wires 140, 142, 144 are coupled to respective terminals 20, 22, 24 of solenoid 12. In one embodiment, the method of FIG. 9 is performed after the blocked pinion test of FIG. 7. As such, blocks 252 and 254 are already completed, and an operator proceeds to block 256 upon removing the blocking gauge 146 (FIG. 8).

Figure 10:
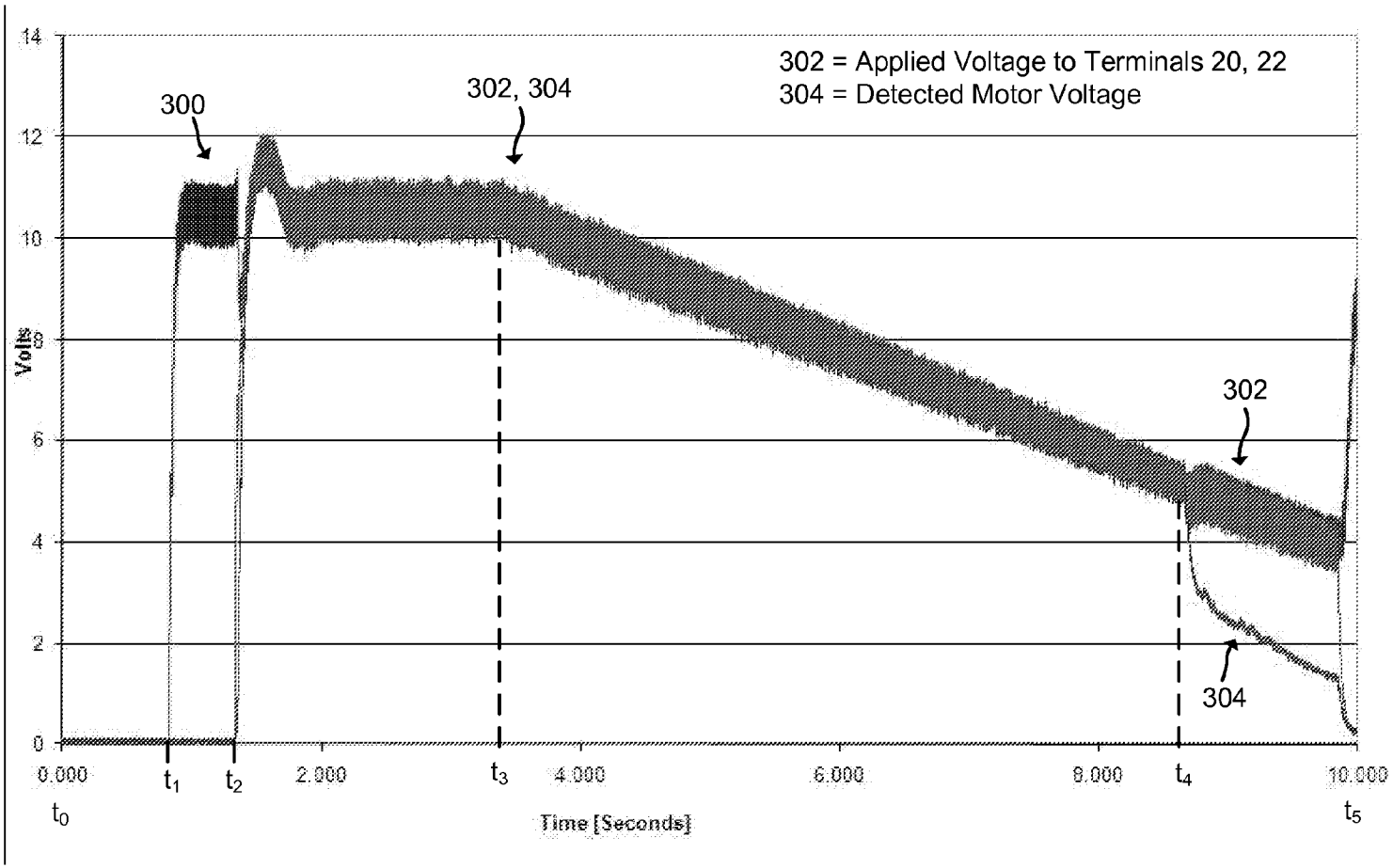
FIG. 10 illustrates a graphical representation of exemplary terminal voltages of a solenoid that passes the test of FIG. 9.
Figure 11:
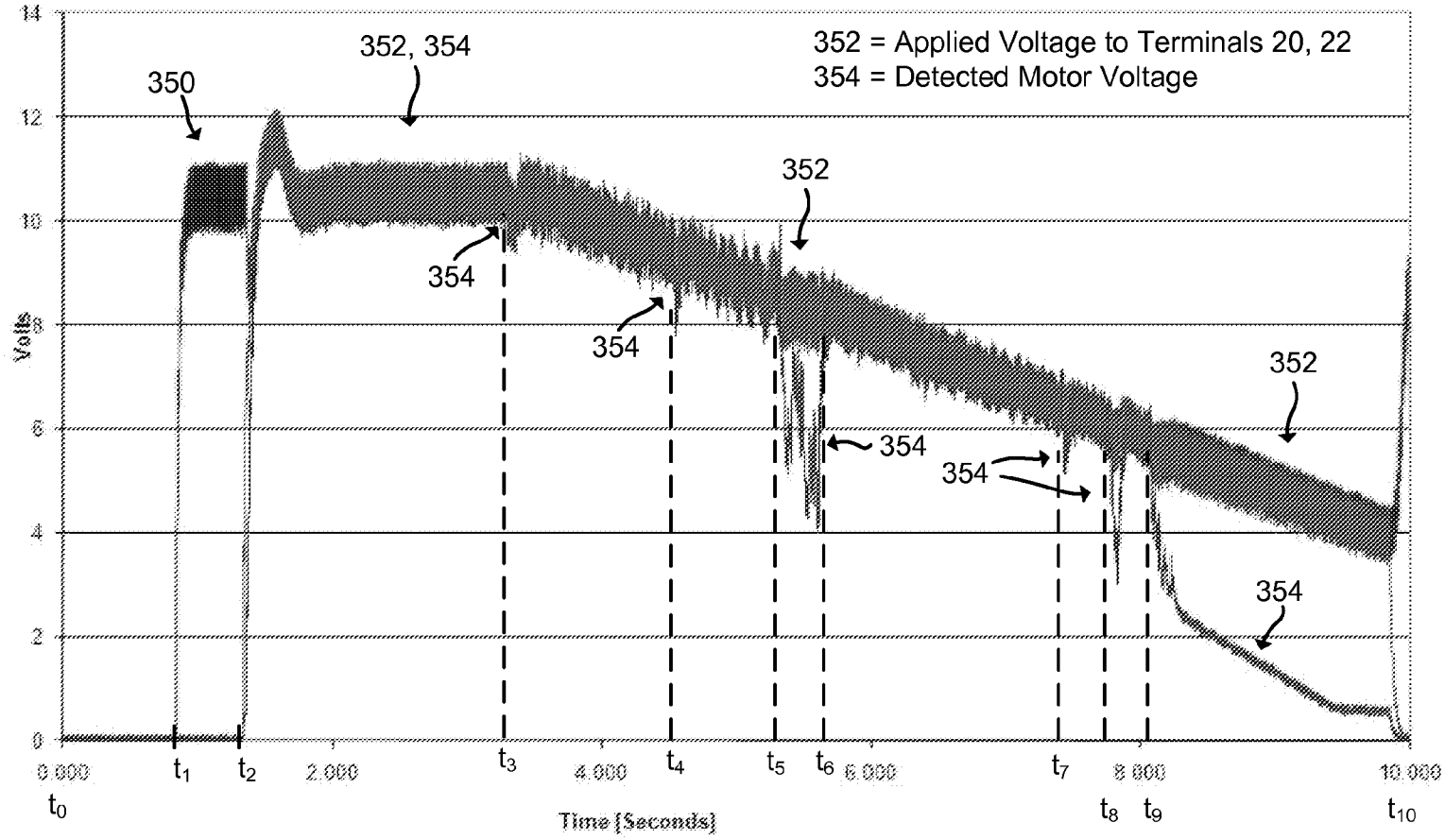
FIG. 11 illustrates a graphical representation of exemplary terminal voltages of a solenoid that fails the test of FIG. 9.

At block 256, an operator initiates the testing sequence, i.e., via one or more user inputs of the test apparatus 100. For example, an operator selects a starter part number or model via computer 120 to initiate the test. In one embodiment, an operator is required to select multiple inputs (e.g., buttons, etc.) to start the testing sequence, such as to facilitate safe operation of the apparatus 100, for example. Reference is made to the graphical diagrams of FIGS. 10 and 11 throughout the following description of the test of blocks 258 through 282. FIGS. 10 and 11 illustrate exemplary sensed voltages at terminals 20, 22, 24 of solenoid assembly 10 as detected by respective leads 140, 142, 144 of test apparatus 100 over an illustrative period of about 10 seconds. FIG. 10 illustrates sensed voltages of a starter assembly 10 that passes the test of FIG. 9, and FIG. 11 is illustrative of a starter assembly 10 that fails the test of FIG. 9, as described herein. In the illustrated embodiment, the initiation of the test at block 256 by an operator corresponds to the zero time ($t_0$) of the diagrams of FIGS. 10 and 11.

At blocks 258-264, computer 120 checks for solenoid leakage current and for a reverse installation of solenoid 12, i.e., whether solenoid 12 is reverse installed such that power line 124 is coupled to motor terminal 24 and motor cable 26 is coupled to battery terminal 20. Such a reverse installation test indicates whether solenoid 12 is reverse installed to starter motor 14 and/or reverse installed to test apparatus 100. In the illustrated embodiment, blocks 258-264 are performed with starter assemblies having multiple input terminals, e.g., starter assembly 10 of FIG. 2. As such, in one embodiment blocks 258-264 are not performed on starter assembly 162 due to starter assembly 162 illustratively having a single input terminal 170 (FIG. 6).

At block 258, control unit 102 applies a signal via line 124 intended for the battery terminal 20 of solenoid 12 for a predetermined time, such as for about one second. In particular, control unit 102 closes switch 128 and directs a signal from power supply 106 over line 124 intended for the battery terminal 20 of solenoid 12. The signal is applied via line 124 while power to solenoid terminal 22 is removed. In one embodiment, the signal applied at block 258 is a voltage signal, such as about 11 VDC. See, for example, voltage signal 300 applied between times $t_1$ and $t_2$ of FIG. 10 and voltage signal 350 applied between times $t_1$ and $t_2$ of FIG. 11. At block 260 of FIG. 9, control unit 102 monitors for solenoid leakage (current flow) through the terminal of solenoid 12 that is connected as the battery terminal 20, i.e., via lead 140. In one embodiment, control unit 102 also monitors voltage at the terminal. If control unit 102 does not detect current through the monitored terminal, then computer 120 determines at block 262 that power line 124 is properly coupled to the battery terminal 20 and not to the motor terminal 24. In particular, with contact disk 46 (FIG. 2) open, substantially no current should be detected at battery terminal 20 despite application of a voltage signal via line 124. If control unit 102 detects a current at the terminal monitored with lead 140, then computer 120 determines at block 262 that solenoid 12 is installed with terminals 20, 24 reversed. In particular, in a reversed installation, motor terminal 24 and coils 40, 42 (FIG. 2) are connected to line 124. With coil 42 grounded, the signal applied at block 258 is received at motor terminal 24 in the reversed installation and detected via lead 140 (or via current sensor 154). As such, the connections (line 124 and cable 26) at terminals 20, 24 must be interchanged at block 264 or the test will continue to fail. Further, blocks 262 and 264 may indicate that solenoid 12 is reverse installed to motor 14 depending on the terminal 20, 24 to which the motor cable 26 is coupled. The result of block 262 is displayed to the user via GUI 122.

In one embodiment, computer 120 also determines whether contact 46 is stuck in the closed position during the application of the signal via line 124 at block 258 between times $t_1$ and $t_2$ of FIGS. 10 and 11. For example, upon detecting current or voltage at the terminal monitored with lead 144 at block 258, computer 120 determines that contact plate 46 is closed. Computer 120 provides notification that the contact plate 46 is stuck closed via display on GUI 122.

In the illustrated embodiment, blocks 258 through 262 are performed automatically by control unit 102 and computer 120 upon an operator initiating the test at block 256 to check for a reversed installation of solenoid 12. In the illustrated tests of FIGS. 10 and 11, the voltage signals 300, 350 are applied for about a half second between times $t_1$ and $t_2$.

At block 266, computer 120 collects voltage and current data acquired via sensing leads 140, 142, 144, 150, 152 and records the data in memory. In one embodiment, computer 120 collects and records the data throughout the test. At block 268, control unit 102 applies power to starter assembly 10 to energize the solenoid 12. In particular, control unit 102 applies a voltage to the solenoid terminal 22 to energize coils 40, 42 and to the battery terminal 20 to cause rotation of motor 14. As such, pinion 16 extends and motor 14 begins to rotate. In the illustrated embodiment, a substantially constant voltage is applied to terminals 20, 22 at block 268 for a predetermined period, such as about two to four seconds, for example. See, for example, applied voltage 302 (about 11 VDC) in FIG. 10 applied to terminals 20, 22 after time $t_2$ that is substantially constant for about two seconds until time $t_3$. Similarly, in FIG. 11 an applied voltage 352 (about 11 VDC) is applied to terminals 20, 22 after time $t_2$ and is substantially constant for about two seconds until time $t_3$. The applied voltages 302, 352 of FIGS. 10 and 11 illustratively represent the voltages applied to both battery and solenoid terminals 20, 22. Alternatively, the voltages applied to each terminal 20, 22 may be different from each other. In another embodiment, about 12 VDC is applied to both terminals 20, 22 to represent a vehicle battery voltage, although other suitable voltages may be applied at block 268 operative to close contact plate 46 and to rotate motor 14. As such, extension of pinion 16 and rotation of the motor 14 is observable by an operator. When testing starter assembly 162 of FIG. 6, voltage/current is applied at block 268 to input terminal 170 to cause pole shoe 168 to extend pinion 16 relative to motor 164 and to cause rotation of motor 164.

At block 270, after a delay equal to the predetermined period, control unit 102 starts varying the applied power. In the illustrated embodiment, control unit 102 varies the applied power by steadily decreasing the voltage level and/or current level or "ramping down" the voltage/current level. Referring to FIG. 10, for example, after the predetermined delay between times $t_2$ and $t_3$, control unit 102 ramps down the applied voltage 302 between times $t_3$ and $t_5$. Applied voltage 302 is illustratively decreased at a substantially steady rate from about 11 VDC at time $t_3$ to about 4 VDC at time $t_5$. Similarly, applied voltage 352 of FIG. 11 is ramped down between times $t_3$ and $t_{10}$. Applied voltage 352 is illustratively decreased at a substantially steady rate from about 11 VDC at time $t_3$ to about 4 VDC at time $t_{10}$. Similarly, when testing starter assembly 162 of FIG. 6, the current level and/or voltage level of the power applied to input terminal 170 is decreased at block 270 at a substantially steady rate.

At block 272, control unit 102 continues to monitor the voltage and current profiles at one or more terminals of the starter assembly 10, 162 during the varying or ramping down of the applied electrical power. In particular, when testing starter assembly 10, control unit 102 monitors battery terminal 20 and motor terminal 24 during the ramping down of the applied voltages at block 272. Based on the monitored terminals 20, 24, computer 120 analyzes an operating condition of the starter assembly 10. In particular, at block 274, computer 120 calculates the difference between the applied voltage at battery terminal 20 and the voltage detected at motor terminal 24. In the illustrated embodiment, the applied voltage at battery terminal 20 and the detected voltage at motor terminal 24 are configured to be substantially the same as long as contact plate 46 (FIG. 2) is closed against contacts 48, 50 (FIG. 2). See, for example, the applied voltage 302 and the detected motor voltage 304 of FIG. 10 substantially superimposed on one another until about time $t_4$ when motor voltage 304 drops in magnitude. Upon the voltage difference between terminals 20, 24 exceeding a predetermined difference threshold at block 274, computer 120 identifies and records the currently applied battery terminal voltage at block 276. A deviation of the motor terminal voltage from the applied battery terminal voltage by more than the threshold amount indicates that contact plate 46 (FIG. 2) is substantially opened or is "chattering" between open and closed positions. In one embodiment, the difference threshold is about 1 VDC, although other voltage differences may be applied as the difference threshold depending on the type and configuration of solenoid 12.

Based on the voltage value identified at block 276, computer 120 determines an operating condition of the solenoid 12 as represented at block 278. In particular, the applied voltage value identified at block 276 is compared to a predetermined threshold value at block 278. As described herein, an exemplary predetermined threshold value is about 6.5 V. If the voltage value at battery terminal 20 identified at block 276 does not exceed the predetermined threshold value at block 278, computer 120 determines that solenoid 12 has passed the test at block 282 and is operating properly according to design/specification. If the voltage value at battery terminal 20 identified at block 276 exceeds the predetermined threshold value at block 278, computer 120 determines that solenoid 12 is faulted and has failed the test at block 282. In one embodiment, computer 120 outputs the results of the test of FIG. 9 as well as the monitored values (e.g., terminal voltages and currents) for display on GUI 122. In one embodiment, computer 120 further provides a printout of the test results and monitored values.

Similarly, when testing starter assembly 162, control unit 102 monitors a current level at terminal 170 at block 272 during the ramping down of the power applied to starter assembly 162. At block 274, computer 120 calculates a difference or variation between the demanded current level (i.e., demanded by control unit 102 at blocks 268, 270) and the actual current level detected at terminal 170 of starter assembly 162. Upon a variation in the actual current level exceeding a threshold variation, computer 120 identifies and records the currently demanded current level at block 276. A variation of the current level at terminal 170 by more than the threshold amount indicates that pole shoe 168 (FIG. 6) is disengaged from bypass switch 172 or is "chattering" between engaged and disengaged positions. In one embodiment, the threshold variation is about 50 A, although other threshold current variations may be used depending on the type and configuration of starter assembly 162. Based on the current value identified at block 276, computer 120 determines an operating condition of the starter assembly 162 at block 278. In particular, the demanded current value identified at block 276 is compared to a predetermined threshold value at block 278. If the demanded current value identified at block 276 does not exceed the predetermined threshold value at block 278, computer 120 determines that starter assembly 162 has passed the test at block 282 and is operating properly according to design/specification. If the current value identified at block 276 exceeds the predetermined threshold value at block 278, computer 120 determines that starter assembly 162 is faulted and has failed the test at block 282. In one embodiment, computer 120 outputs the results for display on GUI 122 and may further provide a printout of the test results and monitored values.

In the illustrated embodiment, the predetermined threshold value of block 278 is based on the type, model, and/or ratings, etc. of the tested starter assembly 10, 162, and different starter assemblies 10, 162 may have different predetermined threshold values. In particular, with reference to starter assembly 10 of FIG. 2, each solenoid 12 has an associated predetermined threshold value that corresponds to the voltage level at battery terminal 20 and at solenoid terminal 22 that should hold contact plate 46 closed. In other words, the tested solenoid 12 is designed to close or to hold closed the contact plate 46 at voltages above the predetermined threshold value associated with that solenoid 12. In the illustrated embodiment, the predetermined threshold value of the tested solenoid 12 is stored in the lookup table(s) of memory 114, and thus the condition of solenoid 12 as determined at block 278 is based on data from the lookup table(s). The applied voltage value identified at block 276 is compared to the predetermined threshold value stored in memory 114 that corresponds to the particular type or model of starter assembly 10 being tested. As such, if contact plate 46 of the tested solenoid 12 opens (as determined at block 274 of FIG. 9) at an applied battery terminal voltage greater than the predetermined threshold value, solenoid 12 is determined to not function according to its specifications, and computer 120 determines that solenoid 12 has failed the test. Similarly, each starter assembly 162 has an associated predetermined threshold current level that is stored in a lookup table of memory 114 and that corresponds to a current level that should hold pole shoe 168 in engagement with bypass switch 172.

In one embodiment, the predetermined threshold value is based on non-ideal operating conditions of the associated starter assembly 10, 162. For example, at hot or cold operating temperatures of the vehicle battery or of starter assembly 10, 162, the voltage and/or current received at the starter assembly terminal may be reduced due to the extreme operating temperatures. Further, old or rusty power cables may add resistance and reduce the voltage level received at the terminal. As such, solenoid 12 of starter assembly 10 may be designed to close at voltages less than the full battery voltage (e.g., less than 12 VDC) to accommodate continued operation of solenoid 12 in non-ideal operating conditions. Similarly, the field coil of starter assembly 162 may be designed to pull pole shoe 168 into contact with bypass switch 172 at a voltage/current level less than the full battery voltage/current to accommodate continued operation of starter assembly 162 in non-ideal operating conditions. As such, in one embodiment, the predetermined threshold value of block 278 is set to a reduced value to represent a "worst-case scenario" operational condition of starter assembly 10, 162.

In one embodiment, a failed test indicates, for example, that solenoid 12 of starter assembly 10 is too weak or faulty to function properly at extreme temperatures. In one embodiment, a failed test indicates that solenoid 12 exhibits "chattering" with repeated opening and closing of contact plate 46 due to, for example, poor or intermittent connections, failing electrical coils, poor plunger 44 configuration or dimensions, etc. In one embodiment, based on a distorted ramp down voltage at battery terminal 20, a failed test indicates that the rotor of motor 14 rubs on the stator field case during motor operation. In one embodiment, a failed test indicates that solenoid 12 or motor 14 requires maintenance or replacement. Other failures of solenoid 12 and/or motor 14 may be determined from analyses of the detected voltages and currents from the chatter voltage test. Similar failed conditions of starter assembly 162 may be determined.

Blocks 272 through 282 of FIG. 9 as applied to testing starter assembly 10 of FIG. 2 are now described with reference to FIGS. 10 and 11. As illustrated in FIG. 10, motor voltage 304 and the applied voltage 302 deviate by more than the difference threshold (block 274) at about time $t_4$. As such, computer 120 identifies and records the applied voltage 302 value at time $t_4$ (at block 276 of FIG. 9), which is illustratively about 5 V in FIG. 10. Computer 120 then compares the identified applied voltage value to the predetermined threshold value associated with the tested solenoid 12 (block 278). Assuming the predetermined threshold value is about 6.5 V, the identified applied voltage value of 5 V does not exceed the predetermined threshold value. Thus, computer 120 determines that the tested starter assembly 10 has passed the test (block 280). In one embodiment, computer 120 confirms that contact 46 is open following the ramping down of the applied voltage 302 after time $t_5$ (i.e., based on the detected motor voltage 304 via lead 144) to verify that contact 46 is not stuck in the closed position following the test.

Referring to the exemplary test of FIG. 11, motor terminal voltage 354 first deviates from the applied voltage 352 at time $t_3$ and again at time $t_4$. However, the deviations do not exceed the exemplary difference threshold of 1 V required at block 274 of FIG. 9, so computer 120 continues to monitor terminals 20, 22, 24 at block 272. Between times $t_5$ and $t_6$, motor voltage 354 again deviates from the applied voltage 352. As illustrated, the deviation exceeds the exemplary difference threshold of 1 V required at block 274, so computer 120 identifies and records the applied voltage value at time $t_5$, which is illustratively about 9 V. Computer 120 then compares the identified applied voltage value to the predetermined threshold value associated with the tested solenoid 12 (block 278). Assuming the predetermined threshold value is about 6.5 V, the identified applied voltage value of 9 V exceeds the predetermined threshold value. Thus, computer 120 determines that the tested starter assembly 10 has failed the test (block 282).

Motor voltage 354 recovers at time $t_6$ before deviating again from the applied voltage 352 at times $t_7$ and $t_8$. At time $t_9$, the motor voltage 354 drops away from the applied voltage 352, thereby indicating that the contact plate 46 is opened. In one embodiment, computer 120 records and analyzes these additional deviations at times $t_7$, $t_8$, $t_9$ to analyze and diagnose the condition of starter assembly 10. In one embodiment, computer 120 confirms that contact 46 is open following the ramping down of the applied voltage 352 after time $t_{10}$ (i.e., based on the detected motor voltage 354 via lead 144) to verify that contact 46 is not stuck in the closed position following the test.

As such, based on the signatures of the detected voltage signals at terminals 20 and 24, computer 120 determines the operational condition of starter assembly 10. In an alternative embodiment, control unit 102 applies a sufficiently low voltage (e.g., 1V to 5V) to terminals 20, 22 at block 268 such that motor 14 is not actuated. Control unit 102 then ramps up the voltage at block 270 towards the full battery power (e.g., 12 VDC) while computer 120 monitors the voltage levels at terminals 20, 24 at which motor 14 begins to rotate (i.e., contact plate 46 closes). Based on a comparison of the voltage at motor terminal 24 and the applied voltage at terminals 20, 22, computer 120 determines when the contact plate 46 has closed with substantially no chatter and records the applied voltage at battery terminal 20. Computer 120 then compares the recorded applied voltage to the threshold of block 278 (FIG. 9) to determine the condition of the tested starter assembly 10.

Although the invention has been described in detail with reference to certain preferred embodiments, variations and modifications exist within the spirit and scope of the invention as described and defined in the following claims.

The invention claimed is:

1. A method of testing an engine starter assembly, the method including:

providing a starter assembly including a solenoid, a motor, an actuating device, and an engagement member coupled to the actuating device, the actuating device being configured to move the engagement member relative to the motor upon electrical power being routed to an input of the starter assembly, and the engagement member being configured to move along a shaft of the motor to engage an engine assembly;

positioning a blocking member proximate the shaft of the motor to block a movement of the engagement member along the shaft of the motor;

applying a voltage to at least one input of the starter assembly to energize the solenoid, the solenoid of the starter assembly being configured to route voltage received at the at least one input of the starter assembly to an output of the solenoid coupled to the motor;

wherein energizing the starter assembly causes the actuating device to move the engagement member into contact with the blocking member;

varying a magnitude of the voltage applied to the at least one input of the starter assembly;

monitoring a voltage level of the voltage routed to the output of the solenoid during the varying of the applied voltage; and analyzing an operating condition of the starter assembly based on the monitoring, the analyzing including calculating a voltage difference between the applied voltage at the input of the solenoid and the monitored voltage at the output of the solenoid, comparing the calculated voltage difference to a difference threshold, and identifying a voltage level of the applied voltage in response to the calculated voltage difference exceeding the difference threshold.

2. The method of claim 1, wherein varying a magnitude of the applied voltage includes decreasing the voltage level of the applied voltage at a substantially steady rate over a predetermined period.

3. The method of claim 1, wherein the analyzing further includes comparing the identified voltage level of the applied voltage to a threshold voltage level, and determining that the operating condition of the starter assembly is a faulted condition in response to the identified voltage level of the applied voltage exceeding the threshold voltage level.

4. The method of claim 3, wherein the threshold voltage level is based on the level of the monitored voltage at the output of the solenoid, and the determining that the operating condition of the starter assembly is the faulted condition is in response to the identified voltage level of the applied voltage exceeding the level of the monitored voltage at the output of the solenoid by more than a threshold amount.

5. The method of claim 1, wherein the voltage is applied to a first input of the solenoid to actuate the solenoid and to a second input of the solenoid, the solenoid being configured to route the applied voltage from the second input of the solenoid to the output of the solenoid upon being actuated by the applied voltage at the first input of the solenoid.

6. The method of claim 5, further including:

prior to applying the voltage to the first and second inputs of the solenoid, applying an electrical signal to one of the second input and the output of the solenoid while power to the first input is substantially removed; and monitoring the other of the second input and the output of the solenoid to detect at least one of a solenoid leakage current and a reverse installation of the solenoid.

7. The method of claim 1, wherein the energized solenoid is configured to hold the engagement member in an extended position along the shaft.

8. A method of testing an engine starter assembly, the method including:

providing a starter assembly including a solenoid, a motor, an actuating device, and an engagement member coupled to the actuating device, the engagement member being configured to move along a shaft of the motor to engage an engine assembly, the solenoid including a first input, a second input, and an output, the output being electrically coupled to the motor, and the actuating device being configured to move the engagement member relative to the motor upon electrical power being routed to at least one of the first input and the second input of the starter assembly;

positioning a blocking member proximate the shaft of the motor to block a movement of the engagement member along the shaft of the motor;

prior to applying a voltage to the first and second inputs of the solenoid, applying an electrical signal to one of the second input and the output of the solenoid while power to the first input is substantially removed;

monitoring the other of the second input and the output of the solenoid for detection of at least one of a solenoid leakage current and a reverse installation of the solenoid;

applying a voltage to the first input of the solenoid to actuate the solenoid and to the second input of the solenoid, the solenoid being configured to route the applied voltage from the second input of the solenoid to the output of the solenoid in response to being actuated by the applied voltage at the first input of the solenoid;

wherein actuating the starter assembly causes the actuating device to move the engagement member into contact with the blocking member;

varying a magnitude of the voltage applied to at least one of the first and second inputs of the solenoid;

monitoring a voltage level of the voltage routed to the output of the solenoid during the varying of the applied voltage; and analyzing an operating condition of the starter assembly based on the monitoring.

9. The method of claim 8, wherein the voltage is applied to the first input and the second input of the solenoid only after removing the electrical signal from the one of the second input and the output of the solenoid.

10. The method of claim 8, wherein varying a magnitude of the applied voltage includes decreasing the voltage level of the applied voltage at a substantially steady rate over a predetermined period.

11. The method of claim 8, wherein the energized solenoid is configured to hold the engagement member in an extended position along the shaft.

12. A method of testing an engine starter assembly, the method including:

providing a starter assembly including a solenoid, a motor, an actuating device, and an engagement member coupled to the actuating device, the actuating device being configured to move the engagement member relative to the motor upon electrical power being routed to an input of the starter assembly, and the engagement member being configured to move along a shaft of the motor to engage an engine assembly;

positioning a blocking member proximate the shaft of the motor to block a movement of the engagement member along the shaft of the motor;

applying electrical power to at least one input of the starter assembly to energize the solenoid, the starter assembly being configured to route electrical power received at the at least one input of the starter assembly to the motor;

wherein energizing the starter assembly causes the actuating device to move the engagement member into contact with the blocking member;

varying a magnitude of the electrical power applied to the at least one input of the starter assembly;

monitoring at least one of a voltage level and a current level of the electrical power routed to the motor of the starter assembly during the varying of the applied electrical power; and analyzing an operating condition of the starter assembly based on the monitoring, the analyzing including detecting a variation in the monitored current level of the electrical power routed to the motor that exceeds a threshold variation, and identifying a demanded current level of the electrical power applied to the at least one input of the starter assembly in response to the detected variation in the monitored current level exceeding the threshold variation.

13. The method of claim 12, wherein the analyzing further includes comparing the demanded current level of the applied electrical power to a threshold current level, and determining that the operating condition of the starter assembly is in a faulted condition in response to the demanded current level of the applied electrical power exceeding the threshold current level.

14. The method of claim 12, wherein varying a magnitude of the applied electrical power includes decreasing at least one of the voltage level and the current level of the applied electrical power at a substantially steady rate over a predetermined period.

15. The method of claim 12, wherein the energized solenoid is configured to hold the engagement member in an extended position along the shaft.

* * * * *